United States Patent [19]

Stapenséa

[11] Patent Number: 4,671,459

[45] Date of Patent: Jun. 9, 1987

[54] REGULATING DEVICE FOR A CENTRAL HEATING PLANT CONTAINING A HOT WATER SUPPLY

[75] Inventor: Jan A. Stapenséa, Gasteren, Netherlands

[73] Assignee: Fasto B.V., Buinen, Netherlands

[21] Appl. No.: 798,010

[22] Filed: Nov. 14, 1985

[30] Foreign Application Priority Data

Nov. 28, 1984 [NL] Netherlands ..... 8403622

[51] Int. Cl.[4] ..... F23N 1/08; F24D 3/08

[52] U.S. Cl. ..... 237/8 R; 236/20 R; 237/19

[58] Field of Search ..... 237/19, 8 R, 56, 8 C; 236/20 R, 46 R

[56] References Cited

U.S. PATENT DOCUMENTS

| | | | |
|---|---|---|---|
| 3,544,005 | 12/1970 | Meier | 237/19 |
| 3,669,351 | 6/1972 | Meier et al. | 237/19 |
| 4,410,135 | 10/1983 | Skyinskus | 237/8 R |
| 4,429,830 | 2/1984 | Forster et al. | 237/19 |

*Primary Examiner*—Henry Bennett
*Attorney, Agent, or Firm*—Edmund M. Jaskiewicz

[57] ABSTRACT

Regulating device for a central heating plant containing a hot water supply, comprising a boiler for heating a heating medium, a pipe for feeding the heating medium to space heating elements, a distribution device which is accommodated in the feed pipe and has a connection to a flow-through heat exchanger which is also connected to a return pipe from the space heating elements to the boiler. A pipe for tap water being provided in the flow-through heat exchanger and said flow-through heat exchanger being provided with a thermostat which operates the distribution device in order to change from circulation through the space heating elements to circulation through the flow-through heat exchanger and vice versa. The thermostat being adjustable to permit setting of the minimum temperature in the flow-through heat exchanger at which the distribution device switches over from space heating to circulation through the flow-through heat exchanger.

3 Claims, 3 Drawing Figures

REGULATING DEVICE FOR A CENTRAL HEATING PLANT CONTAINING A HOT WATER SUPPLY

BACKGROUND OF THE INVENTION

1. Field of the Invention

The present invention relates to a regulating device for a central heating plant containing a hot water supply, comprising a boiler for heating a heating medium, a pipe for feeding the heating medium to space heating elements, a distribution device which is accommodated in the feed pipe and has a connection to a flow-through heat exchanger, which is also connected to a return pipe from the space heating elements to the boiler, while a pipe for tap water is provided in the flow-through heat exchanger, and said flow-through heat exchanger is provided with a thermostat which operates the distribution device and at a particular temperature switches the distributicn device to circulation of the heating medium through the flow-through heat exchanger and at another temperature to circulation of the heating medium through the space heating elements.

2. Description of the Prior Art

Such a regulating device is known for example from Dutch Pat. No. 148.697. in the heating plant described in this patent the thermostat in the flow-through heat exchanger at a temperature of about 55° C. switches the three-way valve to circulation the flow-through heat exchanger and, when a temperature of about 65° C. is reached, switches the three-way valve back to circulation through the space heating elements. This means that the water in the flow-through heat exchanger is kept constantly at an average value of about 60° C.

On the one hand this temperature in the flowthrough heat exchanger means that, apart from heat losses in the pipe between the flow-through heat exchanger and the draw-off point, hot running water is always available immediately; on the other hand, maintaining this high temperature in the flow-through heat exchanger gives rise to considerable energy consumption, particularly during periods when no hot running water is being drawn off.

SUMMARY OF THE INVENTION

The object of the present invention is to produce a regulating device for the hot water supply of a central heating plant, in which there is the possibility of limiting energy losses during the periods when no hot running water is required.

This object is achieved according to the invention through the thermostat being adjustable, in order to permit setting of the minimum temperature in the flow-through heat exchanger at which the distribution device switches over from space heating to circulation through the flow-through heat exchanger.

The use of an adjustable thermostat gives the user the possibility of setting the temperature as desired in the flow-through heat exchanger. Setting at a high temperature has the disadvantage of a high energy loss during long standstill period such as at night, while a lower temperature means that the user has to put up with a longer waiting time before the tap gives hot water at, say, 60° C.

The setting finally selected by the user will be a compromise between energy consumption and the desired comfort.

DESCRIPTION OF THE PREFERRED EMBODIMENT

Figure 1:
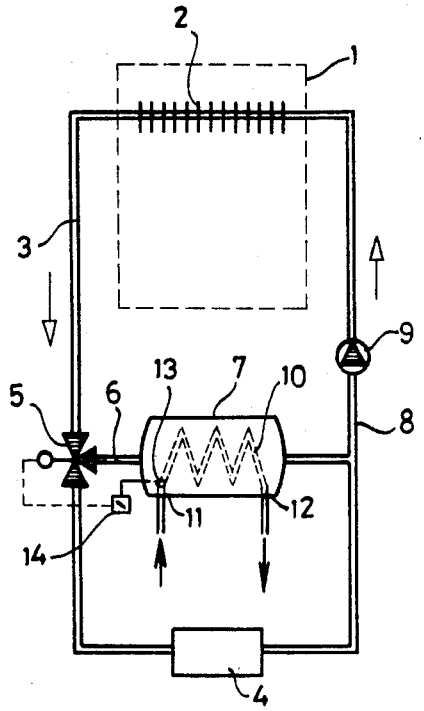
FIG. 1 shows schematically a central heating plant, which is provided with a hot water supply with flow-through heat exchanger.

As can be seen from FIG. 1, the central heating plant comprises a boiler 1, which is provided with a heat exchanger 2 for heating the heating medium, is pipe 3 to supply heating medium to space heating elemenls 4, a three-way valve 5 which is accommodated in the pipe 3 and is connected via a pipe 6 to a flow-through heat exchanger 7, which is also connected to a return pipe 8 running from the space heating elements to the boiler and having therein a circulating pump 9. The flow-through heat exchanger 7 contains a tap water pipe 10, which enters the flow-through heat exchanger at 11 and leaves the flow-through heat exchanger again at 12. The tap water pipe runs with a number of helical windings through the flow-through heat exchanger 7. Positioned inside the flow-through heat exchanger 7 is the sensing element 13 of a thermostat 14, which is placed in the known way in the tap water pipe 10 some distance away from the inlet 11. The sensing element "observes" when water is drawn, and on the basis of this the thermostat switches over the three-way valve 5, so that heating medium is conducted through the flow-through heat exchanger 7.

Accordingly, hot heating medium always flows through the flow-through heat exchanger when hot water is drawn, in order to heat the tap water.

Although the flow-through heat exchanger is insulated, the temperature inside the flow-through heat exchanger will gradually decrease if no hot water is drawn for long periods, such as at night. When the temperature falls to below a predetermined level, the thermostat 14 switches over the three-way valve or distribution device 5, so that hot heating medium is fed to the flow-through heat exchanger. When the temperature inside the flow-through heat exchanger reaches a predetermined value again, the thermostat 14 switches the distribution device back again to space heating.

The thermostat 14 is designed so as to be adjustable and in the embodiment described has a switch with six settings. By means of this switch, it is possible to set the temperature at which the distribution device is switched over from circulation through the space heating elements to circulation through the flow-through heat exchanger and with a switching difference of a fem degrees Celsius to put it back tc circulaticn through the space heating elements.

The heating plant is also provided with regulating equipment for ignition of the burner and for safety purposes, said equipment not forming part of the present invention and therefore not being discussed in any further detail here.

Figure 2:
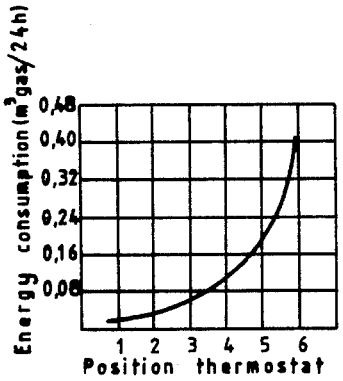
FIG. 2 shows in a graph the relationship between energy consumption and the setting of the thermostat in the flow-through heat exchanger, i.e. the keeping-hot temperature of the flow-through heat exchanger.

FIG. 2 shows the relationship between the setting of the thermostat 14 and the energy consumption in $m^3$ gas per 24 hours. It can be seen clearly in this graph that at the lowest setting 1 of the thermostat the energy consumption is about 0.03 $m^3$ gas, a consumption which inconsumption creases exponentially to 0.4 $m^3$ at the highest setting 6.

Figure 3:
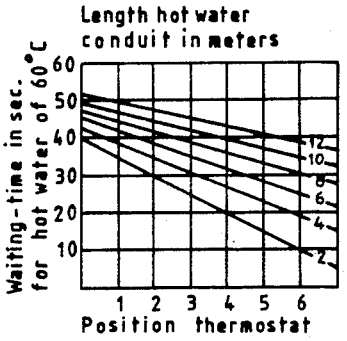
FIG. 3 shows, also in a graph, the relationship between the setting of the thermostat in the flow-through heat exchanger and the waiting time in sec. until running water at 60° C. is available from the tap, depending on the length of the tap pipe in meters.

The graph in FIG. 3 shows the waiting time in sec. before running water at 60° C. is obtained, depending on the setting of the thermostat 14. For example, with a tap pipe 2 meters long, at setting 1 one would have to wait 35 sec. for running water at 60° C. At the highest setting of the thermostat 14 the waiting time is reduced to 10 sec. it is clear from this graph that as the tap pipe increases in length, the difference in waiting time between the lowest and the highest setting becomes relatively smaller. For example, with a tap pipe 12 meters long at setting 1 of the thermostat, the waiting time would be 50 sec., and at the highest setting of the thermostat the waiting time would be about 38 sec. It can therefore be seen clearly from the graph that with longer tap pipes there is only a relatively small loss of comfort if the temperature in the flow-through heat exchanger 7 is kept at a low value.

It will be clear that the temperature going with the lowest setting 1 of the thermostat must always be higher than the temperature of the cold inflowing tap water, otherwise the thermostat can no longer "observe" when water is being drawn and will thus become thermally inoperative.

If hot water is required frequently, despite a low setting of the thermostat 14 a relatively higher temperature will still obtain in the flow-through heat exchanger 7. The saving therefore takes place only when no water is drawn for a long time, for example at night, and the user can, if desired, lower the setting of the thermostat only at night for example by connecting it to a time switch.

The regulating device according to the inventicn therefore enables the user to save energy, at the expense of lengthening the waiting time. Since it can also be seen that with long tap pipes it is pointless to maintain the temperature of the flow-through heat exchanger 7 at a high value, the regulating device according to the invention also provides the opportunity to set the optimum temperature in the flow-through heat exchanger 7, depending on circumstances.

What is claimed is:

1. In a regulating device for a central heating plant having a hot water supply, a boiler for heating a heating medium, at least one space heating element, a feed pipe connected from said boiler to said space heating element and a return pipe from said space heating element to said boiler to define a circulation path, a flow-through heat exchanger connected between said feed pipe and said return pipe, a distribution device in said feed pipe at the connection to said heat exchanger, a pipe for hot tap water passing through said heat exchanger, a thermostat connected to operate said distributor device and responsive to the temperature of the hot water passing through said heat exchanger such that at a first predetermined temperature the distribution device is operated to circulate the heating medium through said heat exchanger and at a second predetermined temperature the distribution device is operated to circulate the heating medium to said space heating element, said thermostat being selectively adjustable to one of a plurality of first predetermined temperatures whereby a lower first predetermined temperature increases the time required to heat the hot water to a desired temperature but reduces the energy necessary to supply the hot water at the desired temperature during a long period when hot water is not used, the first predetermined temperature being lower than the desired temperature.

2. Regulating device according to claim 1, in which the thermostat has a sensing element disposed in the tap water pipe of the flow-through heat exchanger some distance away from the inlet thereof, wherein the thermostat has six settings and the lowest setting is for a temperature which is higher than the temperature of the cold tap water entering the flow-through heat exchanger.

3. Regulating device according to claim 1, wherein the thermostat is connected to a timer.

* * * * *